US010632429B2

(12) United States Patent
Lau

(10) Patent No.: US 10,632,429 B2
(45) Date of Patent: Apr. 28, 2020

(54) BOTTOM-UP LIQUID INFUSION SYSTEM AND INFUSION DEVICE

(71) Applicant: Yuk Hang Lau, Hong Kong (CN)

(72) Inventor: Yuk Hang Lau, Hong Kong (CN)

( * ) Notice: Subject to any disclaimer, the term of this patent is extended or adjusted under 35 U.S.C. 154(b) by 94 days.

(21) Appl. No.: 15/957,330

(22) Filed: Apr. 19, 2018

(65) Prior Publication Data

US 2018/0236416 A1 Aug. 23, 2018

Related U.S. Application Data

(63) Continuation-in-part of application No. PCT/CN2016/108586, filed on May 12, 2016.

(30) Foreign Application Priority Data

Feb. 17, 2017 (HK) ..... 15112780

(51) Int. Cl.

| | |
|---|---|
| ***B01F 3/04*** | (2006.01) |
| ***B67D 1/08*** | (2006.01) |
| ***B67D 1/00*** | (2006.01) |
| ***B01F 5/20*** | (2006.01) |

(52) U.S. Cl.

CPC ..... *B01F 3/04808* (2013.01); *B01F 3/04737* (2013.01); *B01F 5/20* (2013.01); *B67D 1/0082* (2013.01); *B67D 1/0894* (2013.01); *B01F 2003/04872* (2013.01); *B67D 2210/00065* (2013.01)

(58) Field of Classification Search

CPC .... B01F 3/04808; B01F 3/04737; B01F 5/20; B01F 2003/04872; B67D 1/0082; B67D 1/0894; B67D 2210/00065

USPC ..... 261/115, DIG. 7

See application file for complete search history.

(56) References Cited

U.S. PATENT DOCUMENTS

| | | | | |
|---|---|---|---|---|
| 1,845,661 A * | 2/1932 | Haven | B01F 3/04808 261/76 |
| 8,808,775 B2 * | 8/2014 | Novak | A23L 2/54 426/394 |
| 2014/0331867 A1 * | 11/2014 | Novak | B65D 85/73 99/323.2 |

(Continued)

FOREIGN PATENT DOCUMENTS

| | | |
|---|---|---|
| WO | WO 2017/114099 A1 * | 7/2017 |
| WO | WO 2017/114100 A1 * | 7/2017 |

*Primary Examiner* — Charles A Bushey

(74) *Attorney, Agent, or Firm* — Wayne & Ken, LLC; Tony Hom

(57) ABSTRACT

The present invention discloses a bottom-up liquid infusion system. The system includes a container portion and an infusion portion. The container portion includes a container upper body and a container lower body connected with the container upper body. The bottom layer portion of the container upper body is provided with a plurality of upper circulating holes and a plurality of upper protruding plugs. The bottom layer portion of the container lower body is provided with a plurality of lower circulating holes and lower protruding plugs. The container upper body and the container lower body can relatively rotate, and can be transformed between a circulation state and a blocking state. The present invention further discloses an infusion portion. The present invention can realize efficient infusion, does not generate waste and can solve the cost.

18 Claims, 12 Drawing Sheets

(56) References Cited

U.S. PATENT DOCUMENTS

2014/0331868 A1* 11/2014 Novak ..... B65D 85/73
99/323.2

* cited by examiner

BOTTOM-UP LIQUID INFUSION SYSTEM AND INFUSION DEVICE

FIELD OF THE INVENTION

The present invention relates to a liquid infusion apparatus, and more specifically, to a bottom-up liquid infusion system and an infusion portion.

BACKGROUND OF THE INVENTION

Most of dining rooms, aerated water machines, cafe shops, beverage stalls and the like in the current market may apply electrical and mechanical infusion instruments and devices to sell beverages. At present, there are several problems as follows: 1. how to reduce waste caused by leakage when a traditional aerated water machine or any water pouring apparatus applied in various shops, dining rooms and cafe shops fills a cup container from top to bottom while achieving the same function more efficiently; and 2. how to reduce investment amount and long-term power consumption cost of traditional infusion apparatuses/beverage apparatus and the like.

SUMMARY OF THE INVENTION

In order to overcome the above disadvantages, the present invention aims to provide a bottom-up liquid infusion system and an infusion portion capable of realizing efficient infusion, generating no waste and solving the cost.

To achieve the above aim, a technical solution adopted by the present invention is as follows: a bottom-up liquid infusion system comprises a container portion and an infusion portion, wherein the container portion comprises: a container upper body and a container lower body. The container upper body is connected with the container lower body. Bottom layer portions of the container upper body and the container lower body are provided with a plurality of upper circulating holes and lower circulating holes. The bottom layer portions of the container upper body or/and the container lower body are provided with a plurality of protruding plugs having the same number with the upper and lower circulating holes. The container upper body can rotate along the container lower body or the container lower body can rotate along the container upper body in a circumferential direction. The plurality of pairs of upper and lower circulating holes can be converted from an up-down corresponding circulation state into an up-down corresponding blocking state of the circulating holes and the protruding plugs. The infusion portion comprises: an upper connecting member. The upper connecting member is provided with an upper-layer through hole. Liquid flows into the container portion via a liquid circulating pipe successively from the upper-layer through hole and the plurality of pairs of corresponding upper and lower circulating holes. An upper end surface of the upper-layer through hole has a plurality of infusion nozzles. The infusion nozzles correspond to the lower circulating holes. The infusion nozzles are slightly higher than the circulating holes. Infusion nozzle sleeves made of elastic material are respectively arranged on the infusion nozzles.

The bottom-up liquid infusion system of the present invention has the following beneficial effects: the infusion system has an efficient and innovative liquid filling system (applicable to, but not limited to infusion application of all kinds of water, beverages or other liquids, and portionicularly conditions of reducing leakage during infusion while needing rapid and efficient infusion) which is matched with a simple natural flow principle or which generally has a pressure/pneumatic liquid supplying device for perfusing into a liquid container in this design from a source of the liquid container. The application in this design can break through a traditional top-to-bottom pouring manner of beverages, drinks, all kinds of liquids and the like. This specially designed manner is used for simple operation: pressing down the container portion, rotating and then lifting the container portion. The container (cup) is also especially designed for this application, can bear the liquid like an ordinary cup container, can bear the liquid and can prevent the liquid from leaking from the bottom. In addition, the bottom-up liquid infusion system has the following advantages:

1) economic aspect: considering the current global economic condition, most of merchants (of dining rooms, cafe shops, bars and the like) make an effort to reduce operating cost. Therefore, this design can bring the following economic advantages:

a) waste produced due to leakage is further reduced;

b) the time ratio of preparation of beverages in working hours (especially under a condition of hourly wage) is reduced for staff and attendants; more time can be saved for arranging other work tasks, or desired number of staff can be thus reduced [O=T×C; "O"=overhead, "T"=time/hour, "C"=cost of hourly paid employees];

c) this design is matched with a general traditional water infusion apparatus and other simple device element materials to reduce the investment for opening a dining room, a bar and the like (this design adopts a simpler element material relative to the traditional water infusion apparatus or aerated water machine); and d) power consumption cost is reduced in the long term (this design can be operated without any other power supply except in some applications that need refrigeration or heating).

2) Safety aspect: If this design is applied to infusion of high temperature liquid (such as boiled water, hot coffee and the like), the traditional top-to-bottom infusion manner may cause the danger that the high temperature liquid leaks or spills and scalds a human body (such as hands and arms); and the bottom-up infusion method of this design can greatly reduce this dander.

Preferably, the infusion portion further comprises a lower connecting element; a lower-layer through hole is formed in the lower connecting element; and a lower end of the lower-layer through hole is connected with the liquid circulating pipe. The lower connecting element is used for connecting the liquid circulating pipe.

Preferably, the infusion portion can also comprise a telescopic elastic element; the telescopic elastic element is used for connecting the lower connecting element and the upper connecting member; a middle-layer through hole is formed in the telescopic elastic element; and liquid can flow into the container portion successively from the lower-layer through hole, the middle-layer through hole, the upper-layer through hole and the plurality of pairs of corresponding upper and lower circulating holes. The telescopic elastic element can be expanded and contracted; a fixing position for installing a connecting rod is arranged in the lower-layer through hole; an upper end of the connecting rod penetrates through the middle-layer through hole and extends into the upper-layer through hole; an infusion circulating plug is arranged on the upper end of the connecting rod located in the upper-layer through hole; and after the telescopic elastic element can be expanded, the infusion circulating plug can block the upper-layer through hole.

Preferably, the infusion portion can also comprise a container fixing element; the container fixing element is used to contain the container upper body or the container lower body; the container fixing element is connected with the upper connecting member; and a plurality of circulating portions for correspondingly circulating the infusion nozzles and the lower circulating holes are arranged in the container fixing element. The arrangement of the container fixing element is used for connecting the upper connecting member of the infusion portion and the container portion to fix the container portion (which is the container lower body in this demonstration), so that the container portion will not be moved during infusion.

Preferably, the telescopic elastic element has a containing cavity along a circumference of the middle-layer through hole; a spring is arranged in the containing cavity; a plurality of sliding connecting elements are also arranged in the containing cavity; the sliding connecting elements penetrate through the upper end surface of the telescopic elastic element and are connected with the upper connecting member; and the upper connecting member an move along the sliding connecting elements towards a direction close to or away from the telescopic elastic element. The spring and the sliding connecting elements in this demonstration are arranged in the telescopic elastic element, thereby saving the space; when an external force acts on the spring and the spring is compressed, the telescopic elastic element is contracted; when the external force disappears, the spring releases elasticity to force the telescopic elastic element to expand; and the arrangement of the sliding connecting elements is used to play a role of connecting the telescopic elastic element and the upper connecting member.

Preferably, the sliding connecting elements comprise a connecting rod arranged on a bottom of the upper connecting member, and a fixed supporting column arranged in the containing cavity of the telescopic elastic element; the connecting rod and the fixed supporting column are vertically arranged; a lower end of the connecting rod is provided with a connecting column perpendicular to the lower end; the fixed supporting column is provided with a sliding groove which runs in an up-down direction; and the connecting column is clamped in the sliding groove, and can move up and down along the sliding groove. When the telescopic elastic element is contracted, the connecting column slides downwards to the bottom of the sliding groove, and the height of the sliding connecting elements is also decreased, to ensure contraction of the telescopic elastic element; and when the telescopic elastic element is expanded, the connecting column slides upwards to the top of the sliding groove, without influencing the expansion of the telescopic elastic element.

As a further improvement of the present invention, to prevent the liquid from flowing out between every two of the upper connecting member, the telescopic elastic element and the lower connecting element, or between the infusion circulating plug and the upper-layer through hole or between the infusion nozzles and the upper connecting member when the liquid flows from bottom to top, waterproof rings are arranged between the upper-layer through hole and the middle-layer through hole, between the middle-layer through hole and the lower-layer through hole, between the infusion circulating plug and the upper-layer through hole and between the infusion nozzles and the upper connecting member.

Preferably, the height of the container upper body is higher than the height of the container lower body, which is convenient for operators to rotate the container upper body or the container lower body or rotate the container upper body or the container lower body of the container in other manners.

Preferably, the container upper body and the container lower body respectively have a plurality of upper protruding plugs and a plurality of lower protruding plugs; and end surfaces of the upper protruding plugs and the lower protruding plugs are provided with structures of bulges and recesses which are matched mutually. The structure is simple and is derived from rotation of the container upper body.

As a further improvement of the present invention, the shapes of the end surfaces of the upper protruding plugs and the lower protruding plugs are planes consistent with the shapes of the upper circulating holes and the lower circulating holes, so as to ensure that the container upper body and the container lower body will not be moved before application when the container upper body and the container lower body are in the circulation state.

As a still further improvement of the present invention, the container upper body and the container lower body can relatively rotate through cooperation of a clamping groove and a flange, so as to further ensure that the container upper body and the container lower body will not be moved before application.

To achieve the above aim, the present invention further discloses an infusion portion, comprising an upper connecting member. The upper connecting member is provided with an upper-layer through hole. A lower end of the upper-layer through hole is connected with a liquid circulating pipe. The liquid can flow into the container portion successively from the upper-layer through hole and the plurality of pairs of corresponding upper and lower circulating holes. An upper end surface of the upper-layer through hole has a plurality of infusion nozzles. The infusion nozzles correspond to the lower circulating holes. The infusion nozzles are slightly higher than the circulating holes. Infusion nozzle sleeves made of elastic material are respectively arranged on the infusion nozzles.

The infusion portion of the present invention has the following beneficial effects: the infusion system has an efficient and innovative liquid filling system (applicable to, but not limited to infusion application of all kinds of water, beverages or other liquids, and particularly to conditions of reducing leakage during infusion while needing rapid and efficient infusion) which is matched with a simple natural flow principle or which generally has a pressure/pneumatic liquid supplying device for perfusing into the infusion portion in this design from a source of the liquid container. The application in this design can break through a traditional top-to-bottom pouring manner of beverages, drinks, all kinds of liquids and the like. This specially designed manner is used for simple operation: pressing down the container portion, rotating and then lifting the container portion. The container (cup) is also especially designed for this application, can bear the liquid like an ordinary cup container, can bear the liquid and can prevent the liquid from leaking from the bottom. In addition, the infusion portion has the following advantages:

1) economic aspect: considering the current global economic condition, most of merchants (of dining rooms, cafe shops, bars and the like) make an effort to reduce operating cost. Therefore, this design can bring the following economic advantages:

a) waste produced due to leakage is further reduced;

b) the time ratio of preparation of beverages in working hours (especially under a condition of hourly wage) is reduced for staff and attendants; more time can be saved for arranging other work tasks, or desired number of staff can be thus reduced [O=T×C; "O"=overhead, "T"=timeihour, "C"=cost of hourly paid employees];

c) this design is matched with a general traditional water infusion apparatus and other simple device element materials to reduce the investment for opening a dining room, a bar and the like (this design adopts a simpler element material relative to the traditional water infusion apparatus or aerated water machine); and d) power consumption cost is reduced in the long term (this design can be operated without any other power supply except in some applications that need refrigeration or heating).

2) Safety aspect: If this design is applied to infusion of high temperature liquid (such as boiled water, hot coffee and the like), the traditional top-to-bottom infusion manner may cause the danger that the high temperature liquid leaks or spills and scalds a human body (such as hands and arms); and the bottom-up infusion method of this design can greatly reduce this dander.

Preferably, the infusion portion further comprises a lower connecting element; a lower-layer through hole is formed in the lower connecting element; and a lower end of the lower-layer through hole is connected with the liquid circulating pipe. The lower connecting element is used for connecting the liquid circulating pipe and the infusion portion.

Preferably, the infusion portion also comprises a telescopic elastic element; a middle-layer through hole is formed in the telescopic elastic element; the liquid can flow into the container portion successively from the lower-layer through hole, the middle-layer through hole and the upper-layer through hole; the telescopic elastic element can be expanded and contracted; a fixing position for installing a connecting rod is arranged in the lower-layer through hole; an upper end of the connecting rod penetrates through the middle-layer through hole and extends into the upper-layer through hole; an infusion circulating plug is arranged on the upper end of the connecting rod located in the upper-layer through hole; and after the telescopic elastic element can be expanded, the infusion circulating plug can block the upper-layer through hole. The telescopic elastic element is used for connecting the lower connecting element and the upper connecting member.

Preferably, the infusion portion can also comprise a container fixing element; the container fixing element is used to contain the container upper body or the container lower body; the container fixing element is connected with the upper connecting member; and a plurality of circulating portions for correspondingly circulating the infusion nozzles and the lower circulating holes are arranged in the container fixing element. The arrangement of the container fixing element is used for connecting the upper connecting member of the infusion portion and the container portion to fix the container portion (which is the container lower body in this demonstration), so that the container portion will not be moved during infusion.

Preferably, the telescopic elastic element has a containing cavity along a circumference of the middle-layer through hole; a spring is arranged in the containing cavity; a plurality of sliding connecting elements are also arranged in the containing cavity; the sliding connecting elements penetrate through the upper end surface of the telescopic elastic element and are connected with the upper connecting member; and the upper connecting member an move along the sliding connecting elements towards a direction close to or away from the telescopic elastic element. The spring and the sliding connecting elements in this demonstration are arranged in the telescopic elastic element, thereby saving the space; when an external force acts on the spring and the spring is compressed, the telescopic elastic element is contracted; when the external force disappears, the spring releases elasticity to force the telescopic elastic element to expand; and the arrangement of the sliding connecting elements is used to play a role of connecting the telescopic elastic element and the upper connecting member.

Preferably, the sliding connecting elements comprise a connecting rod arranged on a bottom of the upper connecting member, and a fixed supporting column arranged in the containing cavity of the telescopic elastic element; the connecting rod and the fixed supporting column are vertically arranged; a lower end of the connecting rod is provided with a connecting column perpendicular to the lower end; the fixed supporting column is provided with a sliding groove which runs in an up-down direction; and the connecting column is clamped in the sliding groove, and can move up and down along the sliding groove. When the telescopic elastic element is contracted, the connecting column slides downwards to the bottom of the sliding groove, and the height of the sliding connecting elements is also decreased, to ensure contraction of the telescopic elastic element; and when the telescopic elastic element is expanded, the connecting column slides upwards to the top of the sliding groove, without influencing the expansion of the telescopic elastic element.

As a further improvement of the present invention, to prevent the liquid from flowing out between every two of the upper connecting member, the telescopic elastic element and the lower connecting element, or between the infusion circulating plug and the upper-layer through hole or between the infusion nozzles and the upper connecting member when the liquid flows from bottom to top, waterproof rings are arranged between the upper-layer through hole and the middle-layer through hole, between the middle-layer through hole and the lower-layer through hole, between the infusion circulating plug and the upper-layer through hole and between the infusion nozzles and the upper connecting member.

BRIEF DECRYPTION OF THE DRAWINGS

DETAILED DESCRIPTION OF THE INVENTION

Preferred embodiments of the present invention are illustrated in detail below in combination with drawings, so that advantages and features of the present invention are easier to be understood by those skilled in the art, so as to define a protection scope of the present invention more clearly.

Figure 1:
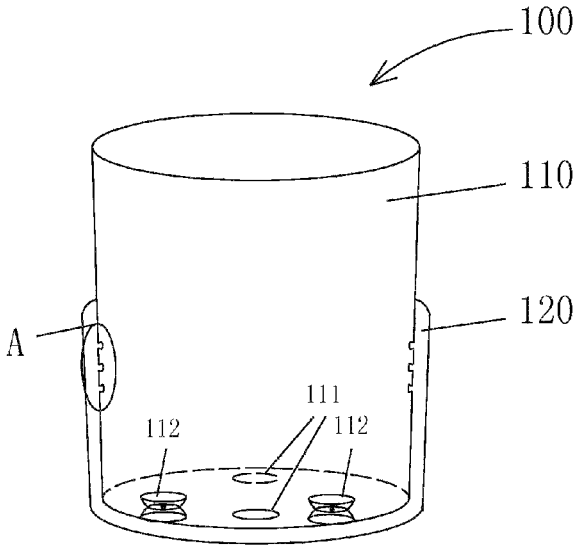
FIG. 1 is a structural schematic diagram of a container portion in the present embodiment.

As shown in FIG. 1, a bottom-up liquid infusion system in the present embodiment comprises a two-portion structure: a container portion 100 and an infusion portion 200.

Figure 3:
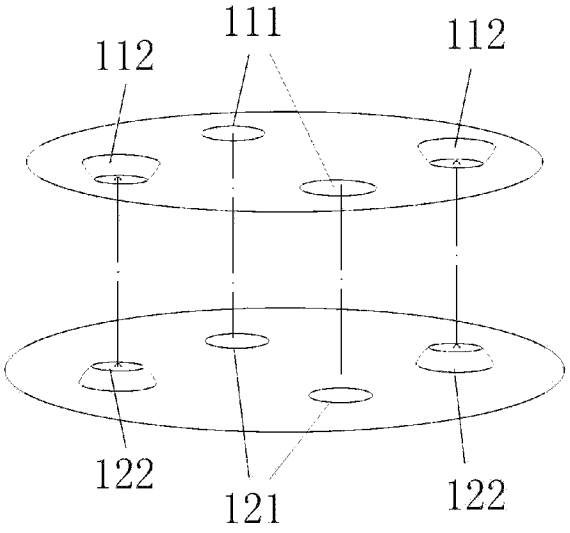
FIG. 3 is a structural schematic diagram when a bottom layer portion of a container upper body and a bottom layer portion of a container lower body are correspondingly in a circulation state in the present embodiment.

As shown in FIG. 1 to FIG. 5, the first portion is the container portion 100:

the container portion 100 comprises: a container upper body 110 and a container lower body 120. The container upper body 110 is connected with the container lower body 120. Specifically, the container upper body 110 is arranged in the container lower body 120. As shown in FIG. 3, the bottom layer portion of the container upper body 110 is provided with two upper circulating holes 111 and two upper protruding plugs 112. In the present embodiment, two pairs of upper and lower circulating holes, two pairs of upper and lower protruded hole plugs, two infusion portions, and two circulating holes are provided, and certainly, the number thereof can also be 3, 4 and the like according to own needs. Correspondingly, the bottom layer portion of the container lower body 120 is provided with two lower circulating holes 121 corresponding to upper circulating holes 111, and two lower protruding plugs 122 corresponding to upper protruding plugs. The height of the container upper body 110 shall be higher than the height of the container lower body 120, which is convenient for operators to rotate the container upper body 110 along the container lower body 120 in a circumferential direction through an external force which acts on the container upper body 110, or otherwise rotate the container lower body 120 along the container upper body 110 in a circumferential direction in other methods, as shown by X direction in FIG. 11. Through rotation, two upper circulating holes 111 and two upper protruding plugs 112 can be converted from a circulation state corresponding to two lower circulating holes 121 and two lower protruding plugs 122 into a blocking state corresponding to the two lower protruding plugs 122 and the two lower circulating holes 121. When the liquid needs to be perfused into the container portion 100 (specifically, the container upper body 110), the container upper body 110 and the container lower body 120 are converted into the circulation state, i.e., two upper circulating holes 111 correspond to two lower circulating holes 121, and two upper protruding plugs 112 correspond to two lower protruding plugs 122; and after the container portion 100 (specifically, the container upper body 110) is filled with the liquid and needs to stop filling, the container upper body 110 and the container lower body 120 are converted into the blocking state, i.e., two upper circulating holes 111 and two lower protruding plugs 122 are correspondingly blocked by the lower protruding plugs 122, and two lower circulating holes 121 and two upper protruding plugs 112 are correspondingly blocked by the upper protruding plugs 112. See the following practical application for the specific principle.

Figure 4:
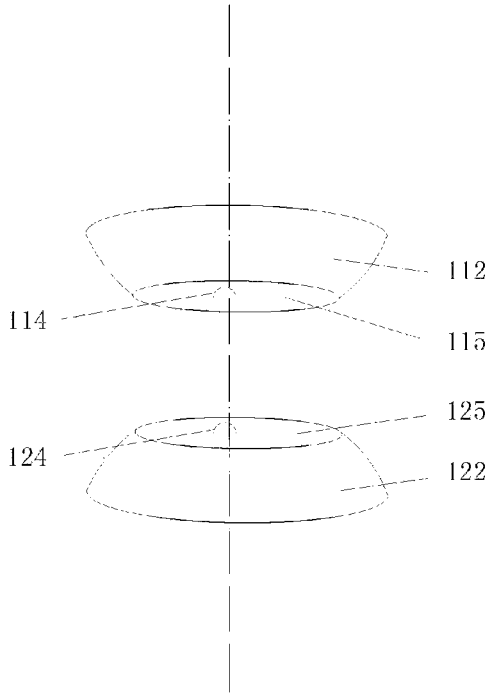
FIG. 4 is a structural schematic diagram in which an upper protruded hole plug corresponds to a lower protruded hole plug in the present embodiment.
Figure 5:
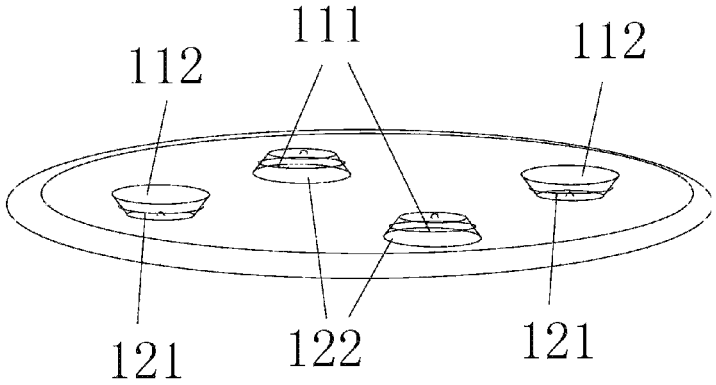
FIG. 5 is a structural schematic diagram when a bottom layer portion of a container upper body and a bottom layer portion of a container lower body are correspondingly in a blocking state in the present embodiment.

In the container portion 100, to ensure that the container upper body 110 and the container lower body 120 will not be moved before application when the container upper body 110 and the container lower body 120 are in the circulation state, as shown in FIG. 4, end surfaces of the upper protruding plugs 112 and the lower protruding plugs 122 are provided with structures of bulges 124 and recesses 114 which are matched mutually. In addition, the shapes of the end surfaces of the upper protruding plugs 112 are planes 115 consistent with the shapes of the upper circulating holes 111; the shapes of the planes 115 in the present embodiment are circular shapes; and correspondingly, the shapes of the end surfaces of the lower protruding plugs 122 are planes consistent with the shapes of the lower circulating holes 121. The two structures aim to prevent the container upper body 110 and the container lower body 120 from moving, and can ensure that the liquid can smoothly enter the container portion 100 (i.e., enter the container upper body 110).

Figure 2:
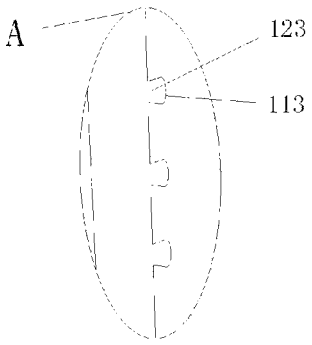
FIG. 2 is a local enlarged diagram of A portion in FIG. 1.

As shown in FIG. 2, the container upper body 110 and the container lower body 120 relatively rotate through cooperation of a clamping groove 113 and a flange 123. To facilitate rotation and reduce the cost of the container portion 100, the container upper body 110 and the container lower body 120 are made of plastics or other low-cost materials.

Figure 6:
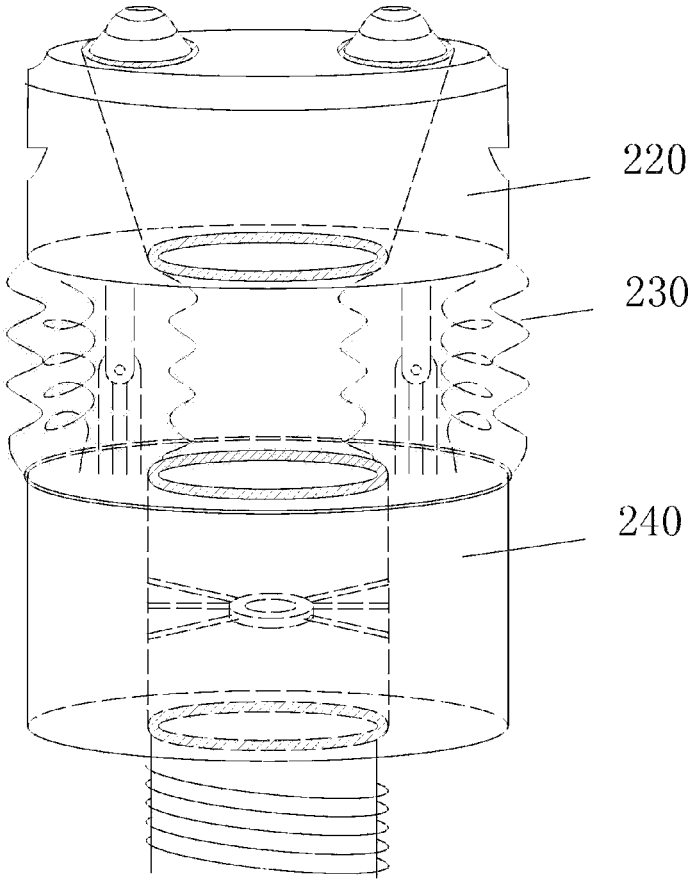
FIG. 6 is a structural schematic diagram after assembly of an upper connecting member, a telescopic elastic element and a lower connecting element in an infusion portion in the present embodiment.
Figure 7:
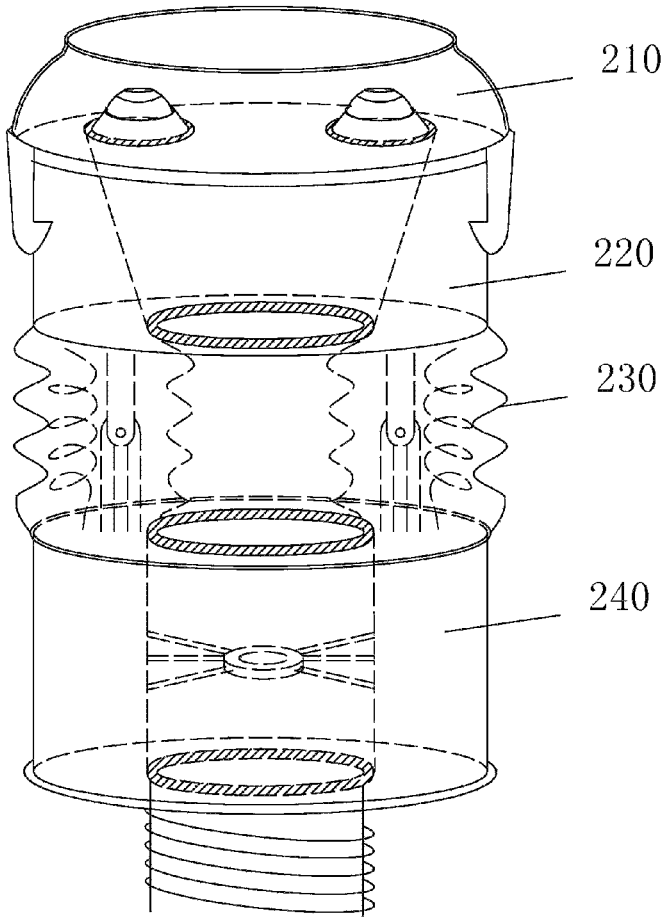
FIG. 7 is a structural schematic diagram after assembly of a container fixing element, an upper connecting member, a telescopic elastic element and a lower connecting element in an infusion portion in the present embodiment.
Figure 8:
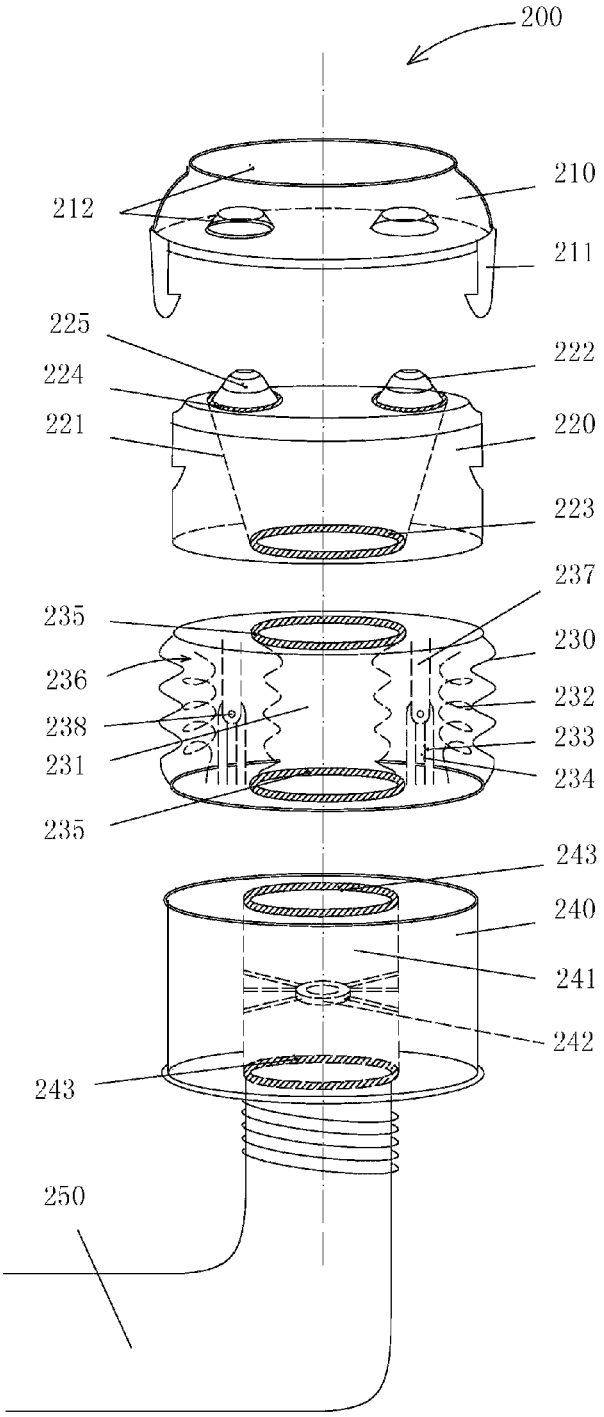
FIG. 8 is an overall exploded diagram of an infusion portion in the present embodiment.
Figure 10:
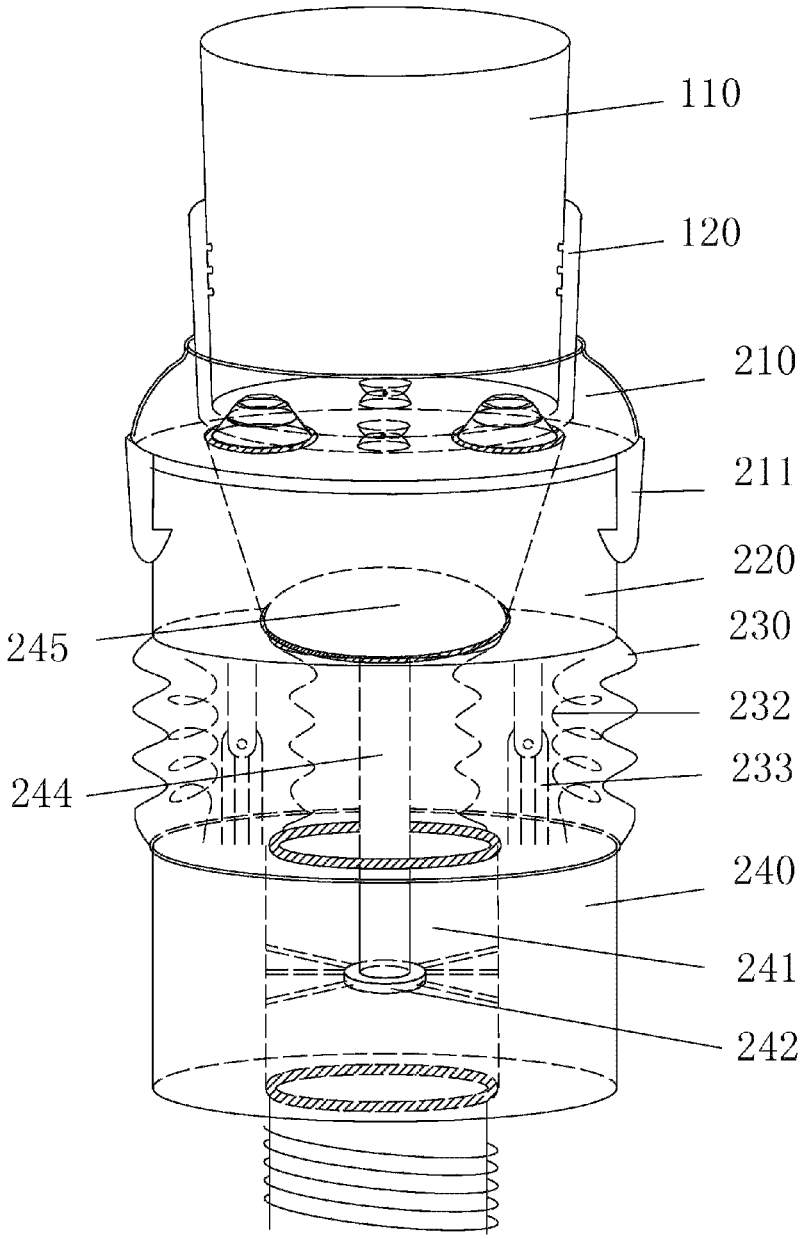
FIG. 10 is a structural schematic diagram after assembly of a container portion and an infusion portion, after installation of a connecting rod and an infusion circulating plug and when the infusion circulating plug blocks an upper-layer through hole in the present embodiment.
Figure 11:
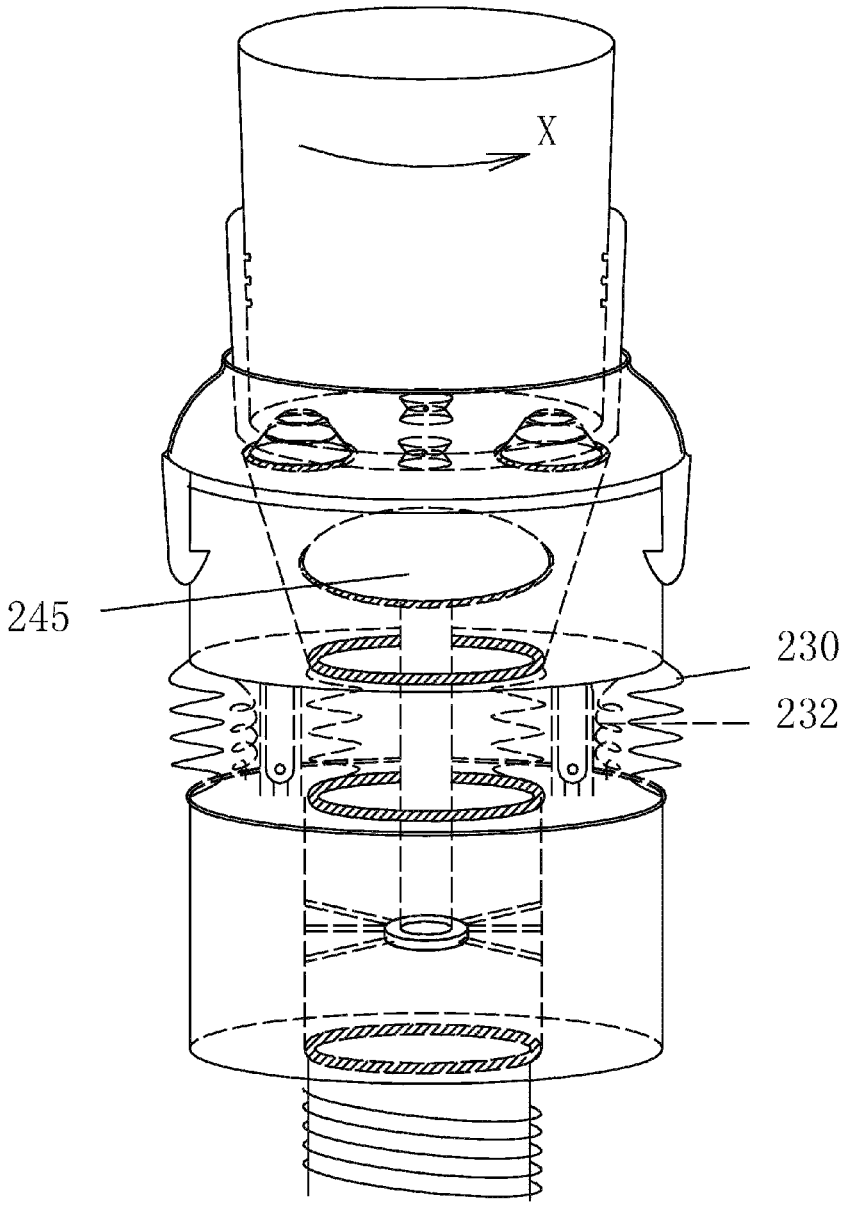
FIG. 11 is a structural schematic diagram after assembly of a container portion and an infusion portion, after pressing of a cup and when an infusion circulating plug does not block an upper-layer through hole in the present embodiment.
Figure 12:
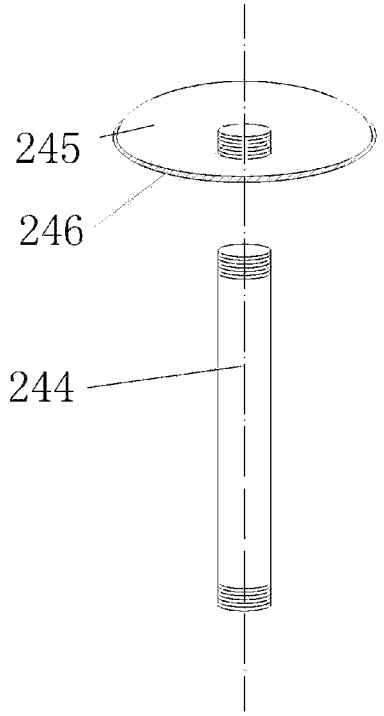
FIG. 12 is an exploded diagram of a connecting rod and an infusion circulating plug in the present embodiment.

As shown in FIGS. 6-8, the second portion is an infusion portion 200:

The infusion portion 200 comprises: an upper connecting member 220, a telescopic elastic element 230 and a lower connecting element 240 which are correspondingly arranged from top to bottom. As shown in FIG. 8, the upper connecting member 220, the telescopic elastic element 230 and the lower connecting element 240 are respectively provided with an upper-layer through hole 221, a middle-layer through hole 231 and a lower-layer through hole 241. A lower end of the lower-layer through hole 241 is connected with a liquid circulating pipe 250. The liquid can flow into the container portion 100 successively from the liquid circulating pipe 250, the lower-layer through hole 241, the middle-layer through hole 231, the upper-layer through hole 221 and two pairs of corresponding upper and lower circulating holes 121. Specifically, an upper end surface of the upper-layer through hole 221 has two infusion nozzles 222, i.e., the liquid can flow into the container portion 100 successively from the liquid circulating pipe 250, the lower-layer through hole 241, the middle-layer through hole 231, two infusion nozzles 222 of the upper-layer through hole 221 and two pairs of corresponding upper and lower circulating holes 111, 121, wherein the upper-layer through holes 221 in the present embodiment have a shape of a funnel, and can also present different shapes and capacities according to individual applications, and the telescopic elastic element 230 can be expanded and contracted. Specifically, the telescopic elastic element 230 adopts an elastic plastic element; a spring 232 used for expansion is arranged in the telescopic elastic element 230; and the spring 232 can also be applied and arranged in other places in the infusion portion 200. A fixing position 242 for installing a connecting rod 244 is arranged in the lower-layer through hole 241. The fixing position 242 is a connecting hole. The aperture of the connecting hole is smaller than the aperture of the lower-layer through hole 241. The liquid flows from the lower-layer through hole 241 except for the fixing position 242 into the middle-layer through hole 231. The connecting rod 244 shown in FIG. 12 is screwed in the fixing position 242. As shown in FIGS. 10 and 11, an upper end of the connecting rod 244 penetrates through the middle-layer through hole 231 and extends into the upper-layer through hole 221; and an infusion circulating plug 245 is arranged on the upper end of the connecting rod 244 located in the upper-layer through hole 221. As shown in FIG. 12, the infusion circulating plug 245 in the present embodiment is connected with the upper end of the connecting rod 244 through a screwing manner, which is convenient for replacing the infusion circulating plug 245 once the infusion circulating plug 245 is damaged. When the telescopic elastic element 230 is expanded through elasticity released by the spring 232, the infusion circulating plug 245 can block the upper-layer through hole 221; otherwise, when an external force acts downwards on the container portion 100, the telescopic elastic element 230 is contracted and the infusion circulating plug 245 will not block the upper-layer through hole 221. At this moment, the liquid can flow into the container portion 100 (the container upper body 110) successively from the lower-layer through hole 241, the middle-layer through hole 231, two infusion nozzles 222 of the upper-layer through hole 221 and two pairs of corresponding upper and lower circulating holes 121.

To avoid influencing the taste of the liquid because the connecting rod 244 and the infusion circulating plug 245 get rusty after soaked in the liquid for a long time, the connecting rod 244 adopts antirust metal, and certainly can adopt other rustless materials according to individual application design.

When the infusion nozzles 222 are installed, two installation ports shall be formed in advance in the upper end surface of the upper connecting member 220, while the quantity of the infusion nozzles 222 can be defined according to individual application design; two infusion nozzles 222 are screwed with the installation ports; two infusion nozzles 222 correspond to two lower circulating holes 121; and the infusion nozzles 222 are slightly higher than the upper circulating holes 111, to ensure that the infusion nozzles 222 are pressed when the container portion 100 is pressed so that the infusion nozzles 222 spray the required liquid into the container upper body 110. infusion nozzle sleeves 225 made of elastic material are respectively arranged on the two infusion nozzles 222. Once the lower circulating hole 121 is aligned, the arrangement of the infusion nozzle sleeves 225 made of elastic material ensures that the infusion nozzles 222 and the lower circulating hole 121 are not easy to move, wherein the infusion nozzle sleeves 225 can adopt infusion nozzle sleeves of rubber material, and more specifically, can adopt infusion nozzle sleeves of silicone.

Figure 9:
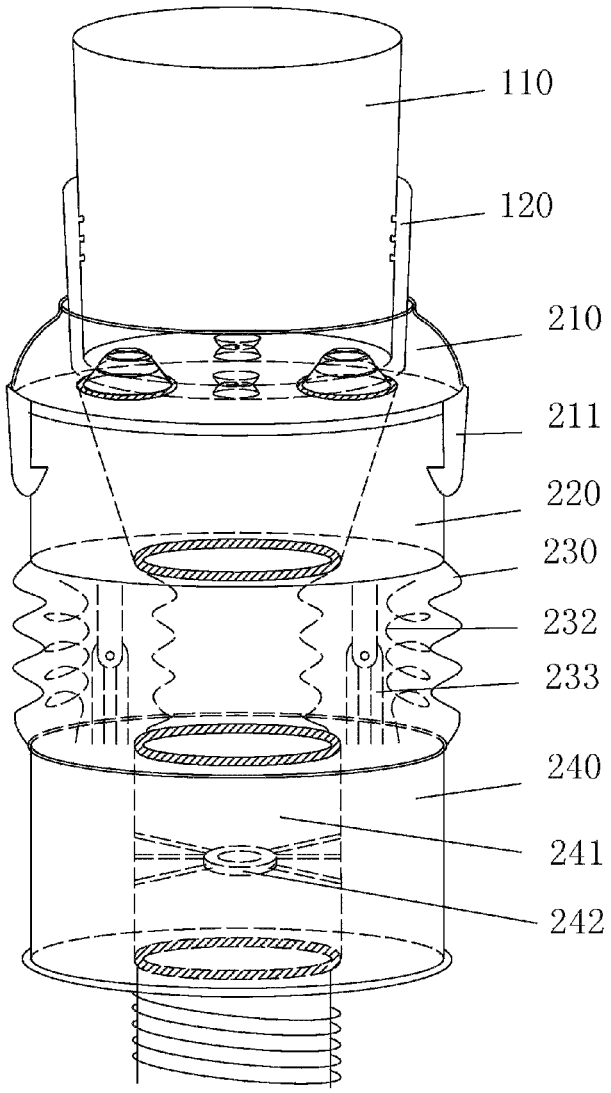
FIG. 9 is a structural schematic diagram after assembly of a container portion and an infusion portion and before installation of a connecting rod and an infusion circulating plug in the present embodiment.

The infusion portion 200 further comprises a container fixing element 210; and the container fixing element 210 is used to contain the container lower body 120. As shown in FIGS. 9-11, the container fixing element 210 is buckled with an outer wall of the upper connecting member 220 through a button 211. In the present embodiment, the button 211 adopts a metal button, two circulating portions 212 for correspondingly circulating the infusion nozzles 222 and two lower circulating holes 121 are arranged in the container fixing element 210, wherein the top material of the container fixing element 210 adopts silicone rubber material, and can also adopt other different materials according to individual application design. The bottom material of the container fixing element 210 adopts heat-resistant elastic silicone rubber material, and can also adopt other different materials according to individual application design. The edge of the lower end surface of the container fixing element 210 adopts an antirust metal ring, and can also adopt other different antirust materials according to individual application design to prevent rust.

As shown in FIG. 8, the telescopic elastic element 230 has a containing cavity 236 along a circumference of the middle-layer through hole 231. The spring 232 is arranged in the containing cavity 236, and can also be used for supporting or expansion in other positions in the infusion portion 200 according to individual application design. A plurality of sliding connecting elements are also arranged in the containing cavity 236. The sliding connecting elements penetrate through the upper end surface of the telescopic elastic element 230 and are connected with the upper connecting member 220. The upper connecting member 220 can move along the sliding connecting elements towards a direction close to or away from the telescopic elastic element 230. The sliding connecting elements comprise a connecting rod 237 arranged on a bottom of the upper connecting member 220, and a fixed supporting column 233 arranged in the containing cavity 236 of the telescopic elastic element. The connecting rod 237 and the fixed supporting column 233 are vertically arranged. A lower end of the connecting rod 237 is provided with a connecting column 238 perpendicular to the lower end. The fixed supporting column 233 is provided with a sliding groove 234 which runs in an up-down direction. The connecting column 238 is clamped in the sliding groove 234, and can move up and down along the sliding groove 234. Similarly, to prevent the sliding connecting elements from getting rusty, the sliding connecting elements adopt antirust metal, and can also adopt other different antirust materials according to individual application design.

To prevent the liquid from flowing into the container portion 100 (the container upper body 110) successively from the lower-layer through hole 241, the middle-layer through hole 231, two infusion nozzles 222 of the upper-layer through hole 221 and two pairs of corresponding upper and lower circulating holes 111, 121, waterproof rings 223, 235 are arranged between the upper-layer through hole 221 and the middle-layer through hole 231, waterproof rings 235, 243 are arranged between the middle-layer through hole 231 and the lower-layer through hole 241, a waterproof ring 246 is arranged between the infusion circulating plug 245 and the upper-layer through hole 221 and a waterproof ring 224 is arranged between the infusion nozzles 222 and the upper connecting member 220. Specifically, the material of the waterproof rings can adopt silicone rubber material, and can also adopt other different materials according to individual application design.

The applicable range of the bottom-up liquid infusion system includes, but not limited to: 1) the application of infusion/packing of all kinds of beverages and other needs; and 2) the application of infusion of other liquids.

Specific Operation Process is Divided into Two Portions.

Step A: Installation step 1: the container portion 100 does not need any assembly by a user; the user can check whether the container portion 100 is in a right and appropriate use phase during supply; two upper circulating holes 111 of the container upper body 110 and lower circulating holes 121 of the container lower body 120 shall be in corresponding positions; meanwhile, two upper protruding plugs 112 of the container upper body 110 and two lower protruding plugs 122 of the container lower body 120 are also corresponding and are mutually abutted; and this is a right phase before use of the cup;

step 2: the infusion portion 200 is already well assembled (the upper connecting member 220 of the infusion portion 200, the telescopic elastic element 230 on the middle layer and the lower connecting element 240 on the bottom layer are already connected together, and the waterproof rings and the like of the silicone rubber material are also installed);

step 3: during use, the infusion portion 200 shall be placed in a position of a use range to allow the user to perfuse the liquid (such as beverages, beer and the like; the infusion apparatus shall be placed in the position of a counter and the like);

step 4: when the infusion portion 200 is properly placed, the infusion circulating plug 245 and the antirust connecting rod 244 are simply tightened;

step 5: the installed infusion circulating plug 245 and the connecting rod 244 are tightened to the fixing position 242 of the lower connecting element 240;

step 6: two infusion nozzles 222 are installed on the installation ports of the upper connecting member 220 (the infusion nozzles 222 are tightened to match the infusion nozzle sleeve 225 and the waterproof rings of the silicone rubber material);

step 7: the container fixing element 210 is placed above the upper connecting member 220 to ensure that the positions of two circulating portions 212 of the container fixing element 210 are aligned with two infusion nozzles 222; the infusion nozzles 222 shall be placed on the container fixing element 210; and then the button 211 beside the container fixing element 210 is buckled with an outer wall of the upper connecting member 220; and step 8: finally, the external liquid circulating pipe 250 is connected to the lower-layer through hole 241 of the lower connecting element 240; and when the liquid is circulated, the liquid is slightly pressed from the upper portion of the infusion portion 200 to observe whether the liquid begins to flow upwards to ensure that the infusion apparatus is properly installed.

Step B: Practical Application step 1: before the container portion 100 is placed above the infusion portion 200, the user shall ensure whether the infusion portion 200 is properly installed and is ready for use; see step 8 in step A;

step 2: the container portion 100 is placed and fixed to the top container fixing element 210; at this moment, two pairs of corresponding circulating holes 111, 121 of the container portion 100 shall be aligned with the positions of two infusion nozzles 222; the infusion nozzles 222 shall also be communicated with the bottom of the container portion 100 from two pairs of corresponding circulating holes; the container fixing element 210 also fixes the contact of the container lower body 120 of the container;

step 3: the container portion 100 is pressed with light force towards the top of the infusion portion 200; at this moment, because the telescopic elastic element 230 on the middle layer of the infusion portion 200 is pressed down, the infusion circulating plug 245 relatively rises and does not block the upper-layer through hole 221; and the liquid (such as water, beverages, beer and the like) begins to flow into the container portion 100 (the container upper body 110) from the lower-layer through hole 241 of the infusion portion 200, the middle-layer through hole 231, and the infusion nozzles 222 of the upper-layer through hole 221;

step 4: when the liquid is completely filled on the bottom of the container portion 100, the operation of pressing the container portion 100 towards the infusion portion 200 can be stopped, or the container upper body 110 is rotated from an outer X direction in other manners (clockwise or counterclockwise, or otherwise the container lower body 120 is rotated); at this moment, the container fixing element 210 may be fixed and does not allow the container lower body 120 to rotate along with the container upper body 110 (or otherwise, a container fixing object 210 may be fixed and does not allow the container upper body 110 to rotate along with the container lower body 120, which is regarded as a different rotation manner); two upper protruding plugs 112 of the container upper body 110 are converted to the positions of blocking two lower circulating holes 121 of the container lower body 120; two lower protruding plugs 122 of the container lower body 120 are converted to the positions of blocking two upper circulating holes 111 of the container upper body 110 to prevent the liquid from leaking from the bottom of the container portion 100 (the container lower body 120); the infusion portion 200 is not pressed; because the originally contracted spring 232 does not bear the pressure, the telescopic elastic element 230 restores elasticity and is "expanded" again, while the inner infusion circulating plug 245 also returns to block the upper-layer through hole 221; and step 5: the container portion 100 is simply lifted and taken out of the container fixing element 210 of the silicone rubber; and at this moment, the liquid in the container portion 100 will not leak because all the circulating holes (two upper circulating holes 111 and two lower circulating holes 121) are blocked by all the protruding plugs (two lower protruding plugs 122 and two upper protruding plugs 112). Although residual liquid exists in positions around the infusion nozzles 222 of the infusion apparatus, the quantity of the residual liquid is small. From a perspective of sanitation, it is not recommended to apply the same container portion 100 on the infusion portion 200 again.

The above embodiments only describe the technical conception and characteristics of the present invention, are not intended to enable those skilled in the art to understand and implement contents of the present invention, and shall not limit the protection scope of the present invention. Any equivalent change or modification made according to the spirits and substances of the present invention shall be included in the protection scope of the present invention.

What is claimed is:

1. A bottom-up liquid infusion system, comprising a container portion (100) and an infusion portion (200), wherein the container portion (100) comprises: a container upper body (110) and a container lower body (120); the container upper body (110) is connected with the container lower body (120); a lower part of the container upper body (110) and the container lower body (120) is provided with a plurality of pairs of upper circulating holes (111) and lower circulating holes (121) corresponding to each other; the lower part of the container upper body (110) or/and the container lower body (120) are provided with a plurality of protruding plugs; the container upper body (110) can rotate along the container lower body (120) or the container lower body (120) can rotate along the container upper body (110) in a circumferential direction; and the plurality of pairs of upper and lower circulating holes (111, 121) can be switched from an up-down corresponding circulation state into an up-down corresponding blocking state of the circulating holes and the protruding plugs; and the infusion portion (200) comprises: an upper connecting member (220); an upper-layer through hole (221) is provided on the upper connecting member (220); liquid flows into the container portion (100) via a liquid circulating pipe (250) successively from the upper-layer through hole (221) and the plurality of pairs of corresponding upper and lower circulating holes (111, 121); an upper end surface of the upper-layer through hole (221) has a plurality of infusion nozzles (222; the infusion nozzles (222) correspond to the lower circulating holes (121); the infusion nozzles (222) are slightly higher than the circulating holes; and infusion nozzle sleeves (225) made of elastic material are respectively arranged on the infusion nozzles (222).

2. The bottom-up liquid infusion system according to claim 1, wherein the infusion portion (200) further comprises a lower connecting element (240); a lower-layer through hole (241) is formed in the lower connecting element (240); and a lower end of the lower-layer through hole (241) is connected with the liquid circulating pipe (250).

3. The bottom-up liquid infusion system according to claim 2, wherein the infusion portion (200) further comprises a telescopic elastic element (230); a middle-layer through hole (231) is formed in the telescopic elastic element (230); the liquid flows into the container portion (100) successively from the lower-layer through hole (241), the middle-layer through hole (231), the upper-layer through hole (221) and the plurality of pairs of corresponding upper and lower circulating holes (111, 121); the telescopic elastic element (230) can be expanded and contracted; a fixing position (242) for installing a connecting rod (244) is arranged in the lower-layer through hole (241); an upper end of the connecting rod (244) penetrates through the middle-layer through hole (231) and extends into the upper-layer through hole (221); an infusion circulating plug (245) is arranged on the upper end of the connecting rod (244) located in the upper-layer through hole (221); and after the telescopic elastic element (230) can be expanded, the infusion circulating plug (245) can block the upper-layer through hole (221).

4. The bottom-up liquid infusion system according to claim 1, wherein the infusion portion (200) further comprises a container fixing element (210); the container fixing element (210) is used to contain the container upper body (110) or the container lower body (120); the container fixing element (210) is connected with the upper connecting member (220); and a plurality of circulating portions (212) for correspondingly circulating the infusion nozzles (222) and the lower circulating holes (121) are arranged in the container fixing element (210).

5. The bottom-up liquid infusion system according to claim 3, wherein the telescopic elastic element (230) has a containing cavity (236) along a circumference of the middle-layer through hole (231); a spring (232) is arranged in the containing cavity (236); a plurality of sliding connecting elements are also arranged in the containing cavity (236); the sliding connecting elements penetrate through the upper end surface of the telescopic elastic element (230) and are connected with the upper connecting member (220); and the upper connecting member (220) can move along the sliding connecting elements towards a direction close to or away from the telescopic elastic element (230).

6. The bottom-up liquid infusion system according to claim 5, wherein the sliding connecting elements comprise a connecting rod (237) arranged on a bottom of the upper connecting member (220), and a fixed supporting column (233) arranged in the containing cavity (236) of the telescopic elastic element; the connecting rod (237) and the fixed supporting column (233) are vertically arranged; a lower end of the connecting rod (237) is provided with a connecting column (238) perpendicular to the lower end; the fixed supporting column (233) is provided with a sliding groove (234) which runs in an up-down direction; and the connecting column (238) is clamped in the sliding groove (234), and can move up and down along the sliding groove (234).

7. The bottom-up liquid infusion system according to claim 3, wherein waterproof rings (223, 235, 243, 224, 246) are arranged between the upper-layer through hole (221) and the middle-layer through hole (231), between the middle-layer through hole (231) and the lower-layer through hole (241), between the infusion circulating plug (245) and the upper-layer through hole (221) and between the infusion nozzles (222) and the upper connecting member (220).

8. The bottom-up liquid infusion system according to claim 1, wherein the height of the container upper body (110) is higher than the height of the container lower body (120).

9. The bottom-up liquid infusion system according to claim 1, wherein the container upper body (110) and the container lower body (120) respectively have a plurality of upper protruding plugs (112) and a plurality of lower protruding plugs (122); and end surfaces of the upper protruding plugs (112) and the lower protruding plugs (122) are provided with structures of bulges (124) and recesses (114) which are matched mutually.

10. The bottom-up liquid infusion system according to claim 9, wherein the shapes of the end surfaces of the upper protruding plugs (112) and the lower protruding plugs (122) are planes (115, 125) consistent with the shapes of the upper circulating holes (111) and the lower circulating holes (121).

11. The bottom-up liquid infusion system according to claim 1, wherein the container upper body (110) and the container lower body (120) can relatively rotate through cooperation of a clamping groove (113) and a flange (123).

12. An infusion portion, comprising an upper connecting member (220), wherein an upper-layer through hole (221) is formed in the upper connecting member (220); a lower end of the upper-layer through hole (221) is connected with a liquid circulating pipe (250); liquid can flow into the container portion (100) successively from the upper-layer through hole (221) and a plurality of pairs of corresponding upper and lower circulating holes (111, 121); an upper end surface of the upper-layer through hole (221) has a plurality of infusion nozzles (222); the infusion nozzles (222) correspond to the lower circulating holes (121); the infusion nozzles (222) are slightly higher than the circulating holes; and infusion nozzle sleeves (225) made of elastic material are respectively arranged on the infusion nozzles (222).

13. The infusion portion according to claim 12, wherein the infusion portion further comprises a lower connecting element (240); a lower-layer through hole (241) is formed in the lower connecting element (240); and a lower end of the lower-layer through hole (241) is connected with the liquid circulating pipe (250).

14. The infusion portion according to claim 13, wherein the infusion portion further comprises a telescopic elastic element (230); a middle-layer through hole (231) is formed in the telescopic elastic element (230); the liquid can flow into the container portion (100) successively from the lower-layer through hole (241), the middle-layer through hole (231) and the upper-layer through hole (221); the telescopic elastic element (230) can be expanded and contracted; a fixing position (242) for installing a connecting rod (244) is arranged in the lower-layer through hole (241); an upper end of the connecting rod (244) penetrates through the middle-layer through hole (231) and extends into the upper-layer through hole (221); an infusion circulating plug (245) is arranged on the upper end of the connecting rod (244) located in the upper-layer through hole (221); and after the telescopic elastic element (230) being expanded, the infusion circulating plug (245) blocks the upper-layer through hole (221).

15. The infusion portion according to claim 12, wherein the infusion portion (200) further comprises a container fixing element (210); the container fixing element (210) is used to contain the container upper body (110) or the container lower body (120); the container fixing element (210) is connected with the upper connecting member (220); and a plurality of circulating portions (212) for correspondingly circulating the infusion nozzles (222) and the lower circulating holes (121) are arranged in the container fixing element (210).

16. The infusion portion according to claim 14, wherein the telescopic elastic element (230) has a containing cavity (236) along a circumference of the middle-layer through hole (231); a spring (232) is arranged in the containing cavity (236); a plurality of sliding connecting elements are also arranged in the containing cavity (236); the sliding connecting elements penetrate through the upper end surface of the telescopic elastic element (230) and are connected with the upper connecting member (220); and the upper connecting member (220) moves along the sliding connecting elements towards a direction close to or away from the telescopic elastic element (230).

17. The infusion portion according to claim 16, wherein the sliding connecting elements comprise a connecting rod (237) arranged on a bottom of the upper connecting member (220), and a fixed supporting column (233) arranged in the containing cavity (236) of the telescopic elastic element; the connecting rod (237) and the fixed supporting column (233) are vertically arranged; a lower end of the connecting rod (237) is provided with a connecting column (238) perpendicular to the lower end; the fixed supporting column (233) is provided with a sliding groove (234) which runs in an up-down direction; and the connecting column (238) is clamped in the sliding groove (234), and can move up and down along the sliding groove (234).

18. The infusion portion according to claim 14, wherein waterproof rings (223, 235, 243, 224, 246) are arranged between the upper-layer through hole (221) and the middle-layer through hole (231), between the middle-layer through hole (231) and the lower-layer through hole (241), between the infusion circulating plug (245) and the upper-layer through hole (221) and between the infusion nozzles (222) and the upper connecting member (220).

* * * * *